United States Patent [19]

Saint Ive

[11] Patent Number: 4,711,453

[45] **Date of Patent: * Dec. 8, 1987**

[54] DICE PYRAMID TALLY BOARD AND GAME

[75] Inventor: Michael H. Saint Ive, Englewood, Colo.

[73] Assignee: Stephen Kal, Denver, Colo.

[ * ] Notice: The portion of the term of this patent subsequent to Apr. 5, 1997 has been disclaimed.

[21] Appl. No.: 284,926

[22] Filed: Jul. 20, 1981

[51] Int. Cl.[4] ..... A63F 3/00

[52] U.S. Cl. ..... 273/268

[58] Field of Search ..... 273/268, 269, 274, 271; 434/98

[56] References Cited

U.S. PATENT DOCUMENTS

| | | | |
|---|---|---|---|
| D. 266,713 | 9/1982 | Ive | D21/34 |
| D. 268,503 | 4/1983 | Ive | D21/34 |
| 803,299 | 10/1905 | Morhous | 273/261 X |
| 4,015,850 | 4/1977 | Russell | 273/269 |
| 4,129,304 | 12/1978 | Mager | 273/243 |

FOREIGN PATENT DOCUMENTS

| | | | |
|---|---|---|---|
| 957,290 | 8/1949 | France | 273/274 |

OTHER PUBLICATIONS

Shake Bingo, Schaper Toys Catalog, Mar. 1978, p. 17.

*Primary Examiner*—Anton O. Oechsle
*Attorney, Agent, or Firm*—Max L. Wymore

[57] ABSTRACT

A one or more player board game and tally pieces. The board has a flat triangular playing surface divided into a triangular grid of 6 on a side to provide a total of 21 intersections corresponding to the absolute number of combinations on the faces of a pair of cubic dice, each having 6 faces with numbers thereon of from 1 through 6 on the faces of each die. When a player rolls the dice, a marker is placed at the intersection of the horizontal line corresponding to the number on one die, usually the low number, according to the numbers along the left edge of the triangle and the upwardly sloping line to the left from the bottom edge of the triangle. There is only one position on the tally board to be tallied for each different value of the dice. A player is permitted to tally each throw of the dice until a repeat is thrown and then the tally is made and the dice are relinquished to the next player.

3 Claims, 15 Drawing Figures

TWO STRAIGHT, 35

TWO STRAIGHT, 7

THREE STRAIGHT,30

POINT VALUE-40

POINT VALUE-57

DICE PYRAMID TALLY BOARD AND GAME

SUMMARY OF THE INVENTION

The object of the invention is to provide a novel tally board that can be used by one or more players to provide an unambiguous tally of the throw of a pair of cubic dice having 6 faces with the numbers 1 through 6 thereon.

The purpose of the game is for a player to throw the dice and tally the value thereof on the novel tally board until a repeat value is thrown whereupon the player's score is tallied up and the dice passed to to the next player.

BRIEF DESCRIPTION OF THE DRAWINGS

Figure 1:
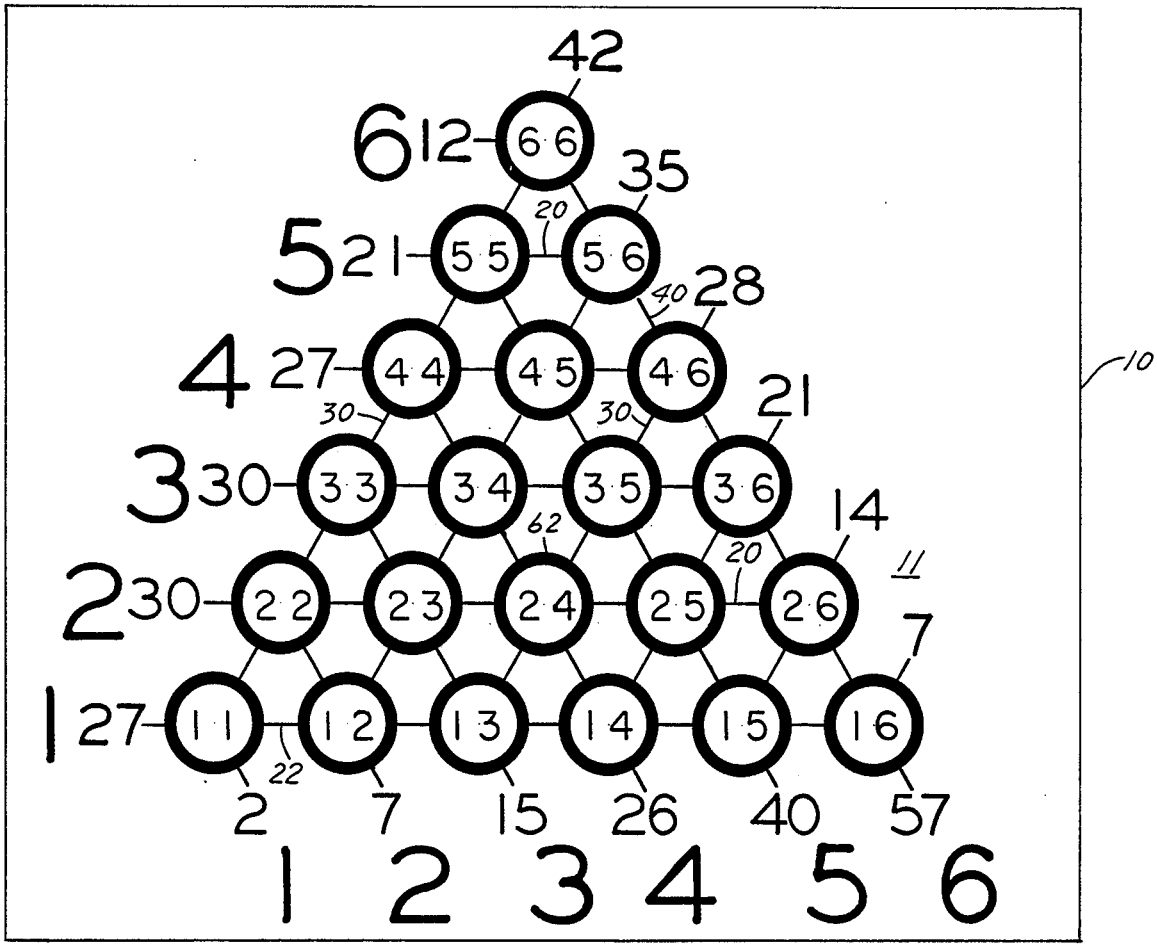
FIG. 1 is a plan view of the board of this invention and represents the derivation of the novel tally board of the present invention from all the possible dice value combinations.
Figure 2:
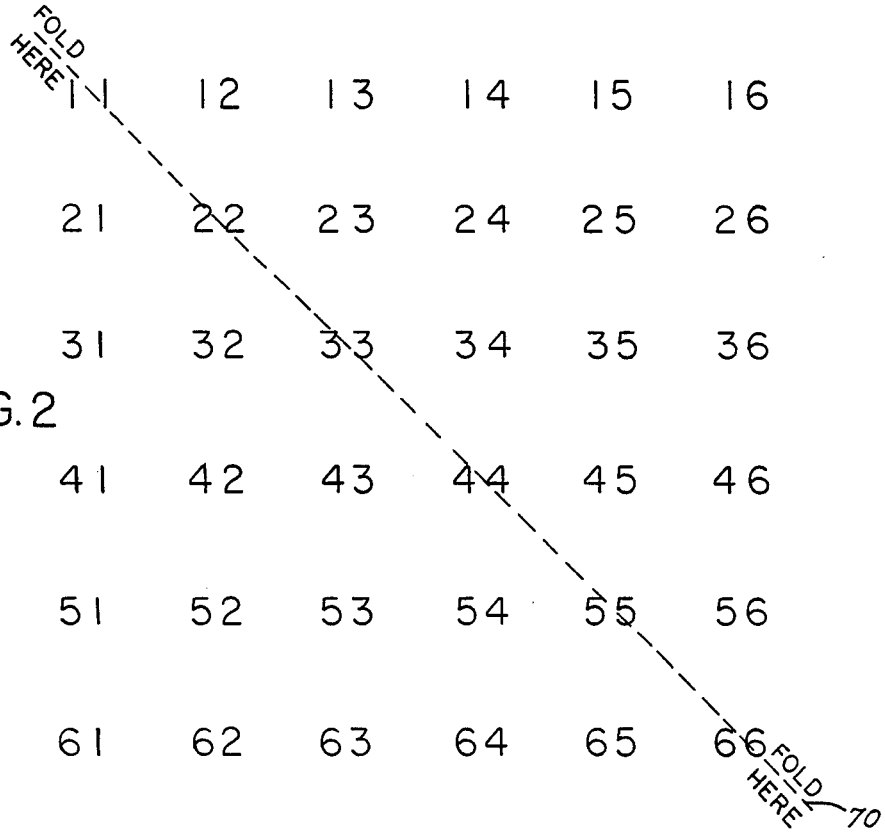
FIG. 2 is a representation of all the numeric values that are available on 2 faces of a pair of cubic dice each having the numbers from 1 through 6 on the faces thereof.

Referring now to FIGS. 1 and 2, a flat rectangular playing or tally board 10 carries an isosceles triangular grid formed by a first set of 6 equidistantly spaced parallel horizontal lines 20 which intersect a second set of 6 vertically oblique lines 30, oblique to the right at a 60° angle with the horizontal lines 20 which also intersect a third set of 6 vertically oblique lines 40, oblique to the left at a 60° angle with the horizontal lines 20. All three sets of intersecting lines combine to provide a 6×6 isosceles triangular matrix. The horizontal lines 20 are numbered from 1 through 6 in ascending order and the vertically oblique lines are numbered from 1 through 6 from left to right where they intersect the lowermost or base line 22. The numerals within the heavy circular rings at each intersection of sets of lines 20, 30 and 40 represent the value of each individual intersection. For example, ring 62 contains the numerals 2 and 4, which correspond to the number of the horizontal line as "2" and the intersecting vertical oblique line "4". The heavy circles are not necessary to the use of the tally board but are included only as a convenience to the new user. After a short time of use, the user will be able to easily arrive at the value of any intersection without these circles. The inner row of numerals along each side of the triangular tally board are used in play and will be explained later.

Referring now to FIG. 2, there is shown a 6×6 rectangular matrix of the combinations that can be produced by the throw of a pair of cubic dice having 6 faces and a number from 1 through 6 on a face. It will be noted that certain combinations such as 1-2 and 2-1 provide for ambiguities as to which would be indicated by the throw of a number 1 on one die and a number 2 on the other die. It will also be noted that the sets of combinations are symmetrical about the diagonal of the square array drawn through all of the doubles 70, shown dotted. If the array is folded along line 70, it will be seen that all of the multiple sets like 1-4 and 4-1 will coincide reducing the possible combinations to a total of 15 plus the 6 doubles for a sum total of 21 combinations with 6 combinations along a side. This is the derivation of the triangular playing and tally board of this invention which serves to reduce the ambiguities by the elimination of duplicate combinations resulting from the throw of a pair of dice.

In the use of the playing or tally board according to the present invention, the following rules may be followed although other rules may be used with equal success. The first player to score 231 points or more is declared winner, unless an opponent on the same turn scores more. Each player is entitled to the same number of turns as the winner.

Figure 3:
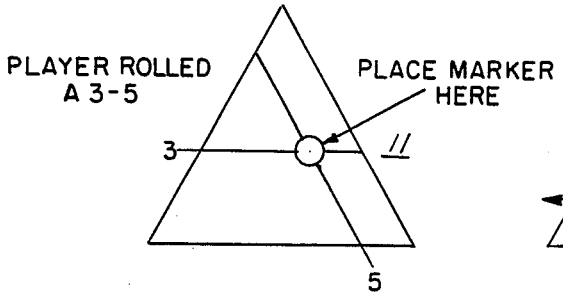
FIG. 3 illustrates the positioning of a marker on the tally board where the die have rolled a 3 and a 5.

Each turn consists of a player rolling the dice until he rolls a repeat combination he has already rolled on that turn. Twenty-one different combinations of the dice can be rolled. The object of the game, known as Master Dice, is to roll a different combination each throw. Once a combination has repeated for a player, that player's turn is over and his points are tallied. As each combination is rolled by a player, a marker is placed on the tally board for that combination. To determine the position of the marker on the tally board, look to the circle combinations on FIG. 1 or use the number from 1 to 6 in the column to the left of the pyramid which corresponds to the number on the low die and then use the number from 1 to 6 in the row at the bottom of the pyramid which corresponds to the number on the high die. Follow the lines to the point of intersection and position the marker there, see FIG. 3. The player continues to roll the dice and position markers on the tally board until the player rolls a repeat combination, i.e. in FIG. 3, the player rolls another 3-5 combination, thereby ending his turn.

Figure 4A:
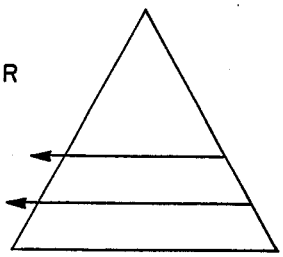
FIGS. 4A, 4B and 4C illustrate the direction of straights on the novel tally board of this invention.
Figure 4B:
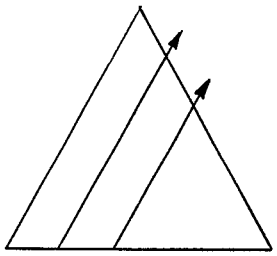
Figure 4C:
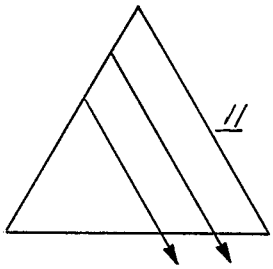
Figure 5A:
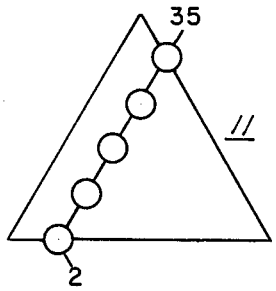
FIGS. 5A, 5B and 5C illustrate the tally of straights on the novel tally board of this invention.
Figure 5B:
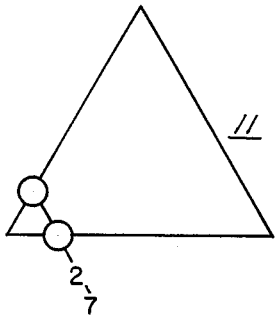
Figure 5C:
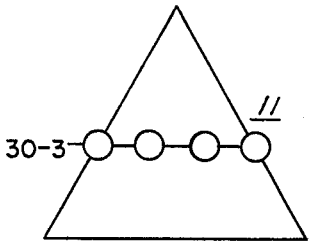
Figure 6A:
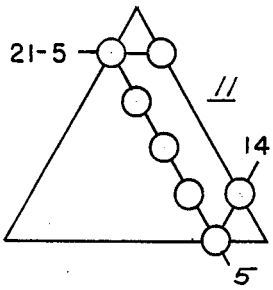
FIGS. 6A and 6B illustrate the use of the highest value straight in the tally.
Figure 6B:
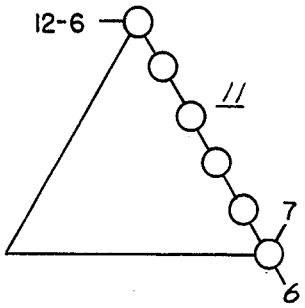
Figure 7A:
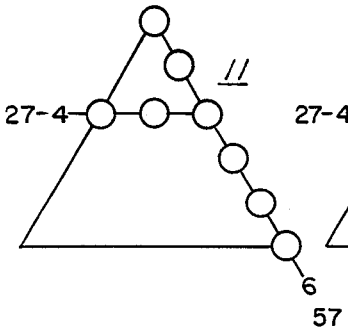
FIGS. 7A, 7B and 7C illustrate the use of values of two straights where a marker contributes to the completion of two intersecting straights; and, FIG. 8 illustrates the highest value tally with the board of this invention.
Figure 7B:
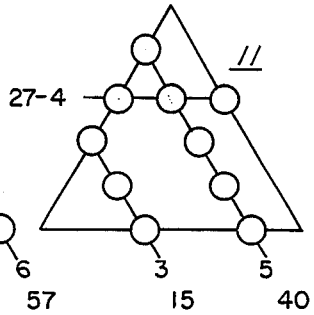
Figure 7C:
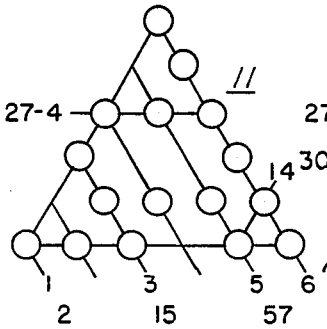

At the end of each player's turn, points are tallied in the following manner. Each player's marker placed on the tally board is worth 1 point unless it is in a straight, FIGS. 4A, 4B and 4C. Straights can run in any of three directions. The value of a straight is determined by following the direction of the straight, FIGS. 4A, 4B, 4C, to the outer edge of the triangle where its point value is shown, see FIGS. 5A, 5B and 5C. There are three straights on the tally board corresponding to each edge number 1 through 6 along the bottom and left edge of the triangle 11. If a marker is used in making more than one of the three possible straights per edge number, the points are tallied from the straight having the highest value, see FIGS. 6A and 6B. If a point marker contributes to the completion of two intersecting straights, not of the same number, points are tallied using values from both straights, see FIGS. 7A, 7B and 7C.

Figure 8:
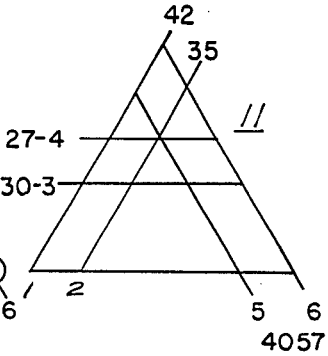

There are three straights possible that consist of only one point marker. They are found at the corners of the triangle. If the tally board is filled on one turn, that is, all 21 different combinations, without duplication, are rolled, the player's score will be 231 points. This score is arrived at by adding the point value of the highest, i.e. 6, 5, 4, 3, 2, 1 straights, see FIG. 8.

While this invention has been described with particular reference to the drawings, the protection sought is to be limited only by the terms of the claims which follow.

What is claimed is:

1. A flat playing board having a triangular grid defined by a first set of 6 parallel equidistant spaced horizontal lines which intersect a second set of 6 parallel equidistant spaced vertically oblique lines, oblique to the right with the horizontal lines, which also intersect a third set of 6 parallel equidistant spaced vertically oblique to the left lines and the 6 lines vertically oblique to the right lines, oblique to the left with the horizontal lines, the lines in each set extending at an angle to the lines of the other sets;

a row of numbers from 1 through 6 along the bottom of the triangular grid with the numbers positioned from left to right to correspond to the intersection of the 6 vertically oblique to the left lines and the 6 lines vertically oblique to the right lines with the horizontal line; and, a row of numbers from 1 through 6 along the left edge of the triangular grid with the numbers positioned from bottom to top to correspond to the intersection of the 6 horizontal lines with the 6 vertically oblique to the left lines and the 6 lines vertically oblique to the right lines.

2. The playing board of claim 1 wherein the triangular grid is an isosceles triangle.

3. The playing board of claim 2 wherein the intersection of each vertically oblique lines with the horizontal line is provided with a numerical indica corresponding to both numbers positioned along the bottom and the left edge of the triangle.

* * * * *